US006353430B2

(12) United States Patent
Cheng et al.

(10) Patent No.: US 6,353,430 B2
(45) **Date of Patent: *Mar. 5, 2002**

(54) GIMBAL MOUNTED JOY STICK WITH Z-AXIS SWITCH

(75) Inventors: Wen Feng Cheng; Chiao Pu Huang, both of Kaohisung (TW)

(73) Assignee: CTS Corporation, Elkhart, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/274,951

(22) Filed: Mar. 23, 1999

(51) Int. Cl.[7] ..... G09G 1/100

(52) U.S. Cl. ..... 345/161; 345/168; 200/6 R; 200/6 A

(58) Field of Search ..... 345/161, 163, 345/168, 169, 160; 200/6 R, 6 A

(56) References Cited

U.S. PATENT DOCUMENTS

| | | | | |
|---|---|---|---|---|
| 3,394,611 A | | 7/1968 | Beurrier | |
| 4,325,050 A | * | 4/1982 | Suszynski | 345/161 |
| 4,375,631 A | | 3/1983 | Goldberg | |
| 4,490,710 A | * | 12/1984 | Kopsho, Jr. et al. | 345/161 |
| 4,559,420 A | | 12/1985 | Yamada | |
| 4,587,510 A | | 5/1986 | Kim | |
| 4,620,176 A | | 10/1986 | Hayes | |
| 4,670,743 A | * | 6/1987 | Zemke | 345/161 |
| 4,729,253 A | | 3/1988 | Rosheim | |
| 4,738,412 A | | 4/1988 | Ozunas | |
| 4,772,892 A | | 9/1988 | Payelian et al. | |
| 4,788,872 A | | 12/1988 | Bennett | |
| 4,795,952 A | | 1/1989 | Brandstetter | |
| 5,068,498 A | * | 11/1991 | Engel | 200/6 A |
| 5,229,742 A | | 7/1993 | Miyamoto | |
| 5,293,158 A | * | 3/1994 | Soma | 345/161 |
| 5,473,325 A | | 12/1995 | McAlindon | |
| 5,563,629 A | | 10/1996 | Caprara | |
| 5,823,057 A | | 10/1998 | Hsien | |
| 5,986,645 A | * | 11/1999 | Brooks | 345/161 |
| 6,059,660 A | * | 5/2000 | Takada et al. | 463/38 |
| 6,078,247 A | | 6/2000 | Shimomura | |

FOREIGN PATENT DOCUMENTS

| | | |
|---|---|---|
| DE | 41 23 503 C2 | 4/1995 |

* cited by examiner

*Primary Examiner*—Richard Hjerpe
*Assistant Examiner*—Kimnhung Nguyen
(74) *Attorney, Agent, or Firm*—Mark Bourgeois; Mark Borgman

(57) ABSTRACT

A control device, like a pointing stick, for controlling the positioning, movement and operation of a responsive electrical device, like a cursor on a computer display screen. There is a compact gimbal mounted joystick 10 that has a stick assembly 14; a gimbal assembly 12 having the stick assembly mounted thereon; a sensor 42 and 44, mounted to the gimbal assembly, for generating an output signal indicative of a position of the stick assembly; and a switch 50, positioned below the stick assembly, to be activated when the stick assembly is sufficiently displaced to close the switch. Additionally there is a biasing means 56, positioned about the switch and extending to the gimbal assembly, the biasing means forcing the gimbal assembly into a centering position when not in use. Additionally, there is a retainer 58, positioned between the gimbal assembly and the biasing means, for forcing the biasing means toward the switch when the stick assembly and gimbal assembly have a moving force applied thereto, and for forcing the gimbal assembly and stick assembly into the centering position after the moving force is eliminated. Uniquely, the gimbal assembly, at a location that contacts the retainer, has a shape that minimizes a torque about the first and second yokes when in the centering position and that increases the torque when the first and second yokes are in a non-centering position.

1 Claim, 3 Drawing Sheets

GIMBAL MOUNTED JOY STICK WITH Z-AXIS SWITCH

BACKGROUND OF THE PREFERRED EMBODIMENT(S)

1. FIELD OF THE PREFERRED EMBODIMENT(S)

This invention generally relates to a control device, like a pointing stick, for controlling the positioning, movement and operation of a responsive electrical device, like a cursor on a computer display screen. Specifically, there is a compact gimbal mounted joystick with an in-line z-axis switch that can, for example, both direct a cursor on a screen and select items on the display screen by tapping on the pointing stick instead of clicking a mouse button.

2. DESCRIPTION OF THE RELATED ART

Various devices are well known for controlling cursor movement over a computer display screen of a computer and for signaling a choice of computer command identified by the position of the cursor on the display screen menu. The most commonly known devices are known as a "mouse" that has a ball on its underside rolled over a horizontal surface, with the x- and y-axis components of movement being sensed and transmitted through a connecting cable to a serial input port of the computer. The signal to the computer is varied by the amount and direction of movement of the mouse ball, and causes the cursor on the display screen to have a corresponding movement. One or two "mouse" or "click" buttons, located on the top of the mouse at the forward end, permit the computer operator to enter a selection or other command to the computer (the command typically being shown by the position of the cursor on a displayed menu) upon pressing one or the other or both buttons, depending upon the software associated with the device. Such a device, requires a flat, horizontal surface.

Another well known electrical controlling and signaling mechanism is a "joystick." The joystick is typically an elongated stick that extends upwardly from a base connected to the computer console by means of a cable. The joystick is operated by tilting the upstanding stick in various directions to cause the cursor or other display element to move in a direction and usually at a speed corresponding to the direction and pressure exerted on the stick by the computer operator. The operation of a joystick, however, frequently requires a separate button to be pushed, for example, to select icons on the screen.

Despite the advantages of each type of controller, none had, for example, allowed the user to both control a cursor movement and select items on the display screen using exclusively a single part of the device, namely a shaft, and being exclusively manipulated and activated by potentially using only one finger. Additionally, it is important to have an extremely small footprint, or small surface area used on a printed circuit board that has the joystick mounted thereon. Moreover, it is important to have as few parts to the design as possible, to reduce the complexity and cost of manufacturing. Finally, it is important that any joystick design have a centering position having the stick or main shaft pointing straight up when not in use. Most prior art designs have complex and costly methods of achieving the centering position.

DESCRIPTION OF THE RELATED ART

Examples of patents related to the present invention are as follows, wherein each patent is herein incorporated by reference for related and supporting teachings:

U.S. Pat. No. 5,563,629, is a device for pointing the cursor on the screen of interactive systems.

U.S. Pat. No. 4,795,952, is a joystick for three axis control of a powered element.

U.S. Pat. No. 4,788,872, is a reamable spring caged and energized free gyro.

U.S. Pat. No. 4,772,892, is a two-axis gimbal.

U.S. Pat. No. 4,738,412, is an air stabilized gimbal platform.

U.S. Pat. No. 4,729,253, is a wrist actuator.

The foregoing patents reflect the state of the art of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, applicant's claimed invention.

SUMMARY OF THE PREFERRED EMBODIMENT(S)

It is a feature of the invention to provide a control device, like a pointing stick, for controlling the positioning, movement and operation of a responsive electrical device, like a cursor on a computer display screen.

A further feature of the invention is to provide a control device assembly with a compact gimbal mounted joystick with an in-line z-axis switch that can, for example, both direct a cursor on a screen and select items on the display screen by tapping on the pointing stick instead of clicking a mouse button.

Yet, a further feature of the invention is to provide a device that has a stick assembly; a gimbal assembly having the stick assembly mounted thereon; a sensor, mounted to the gimbal assembly, for generating an output signal indicative of a position of the stick assembly; and a switch, positioned below the stick assembly, to be activated when the stick assembly is sufficiently displaced to close the switch.

Where the stick assembly includes a shaft, having a mounting hole for pivotally and slidably securing the shaft to the gimbal assembly; and a cap, mounted to one end of the shaft, positioned and designed to close the switch upon being vertically displaced.

Wherein the gimbal assembly includes a first and second yoke, coupled to the stick assembly and sensor, for allowing the stick assembly to move while sensing the position thereof.

A further feature of the invention provides a housing assembly, having a slot and three holes for mounting the first and second yoke ends therein; and an opening for extending the stick assembly therethrough to allow for free movement thereof. Additionally, there is a hinge pin that extends through the second yoke and shaft to allow the shaft to pivotally move; and a first and second groove located in the first and second yokes respectively, designed to allow the shaft to slide therethrough.

Wherein the sensor comprises a first and second position sensor, each mounted to the housing assembly to allow the sensing of a rotational position of the first and second yokes.

Wherein the first and second yokes are rotatably coupled to the first and second sensors via first and second tabs respectively.

An additional feature of the invention includes a biasing means, positioned about the switch and extending to the gimbal assembly, the biasing means forcing the gimbal assembly into a centering position. Additionally, there is a retainer, positioned between the gimbal assembly and the biasing means, for forcing the biasing means toward the switch when the stick assembly and gimbal assembly have a moving force applied thereto, and for forcing the gimbal assembly and stick assembly into the centering position after the moving force is eliminated.

Wherein the gimbal assembly includes a first and second yoke, coupled to the stick assembly and sensor, for allowing the stick assembly to move while sensing the position thereof.

Wherein the first and second yokes, at a location that contacts the retainer, have a shape that minimizes a torque about the first and second yokes when in the centering position and that increases the torque when the first and second yokes are in a non-centering position.

The invention resides not in any one of these features per se, but rather in the particular combination of all of them herein disclosed and claimed and it is distinguished from the prior art in this combination of all of its structures for the functions specified.

There has thus been outlined, rather broadly, the more important features of the invention so that the detailed description thereof that follows may be better understood, and so that the present contribution to the art may be better appreciated. There are, of course, additional features of the invention that will be described after this which will form the subject matter of the appended claims. Those skilled in the art will appreciate that the preferred embodiment may readily be used as a basis for designing other structures, methods and systems for carrying out the several purposes of the present invention. It is important, therefore, that the claims are regarded as including such equivalent constructions since they do not depart from the spirit and scope of the present invention.

BRIEF DESCRIPTION OF THE DRAWINGS

These and other features of the invention can best be understood by the following description of the accompanying drawings as follows.

It is noted that the drawings of the invention are generally not to an exact scale. The drawings are merely schematic representations, not intended to portray specific parameters of the invention. The drawings are intended to depict only typical embodiments of the invention, and therefore should not be considered as limiting the scope of the invention. Additionally, identical numbers are used in different drawings to represent identical parts of the invention. The invention will be described with additional specificity and detail through the accompanying drawings.

DETAILED DESCRIPTION OF THE PREFERRED EMBODIMENT

Figure 1:
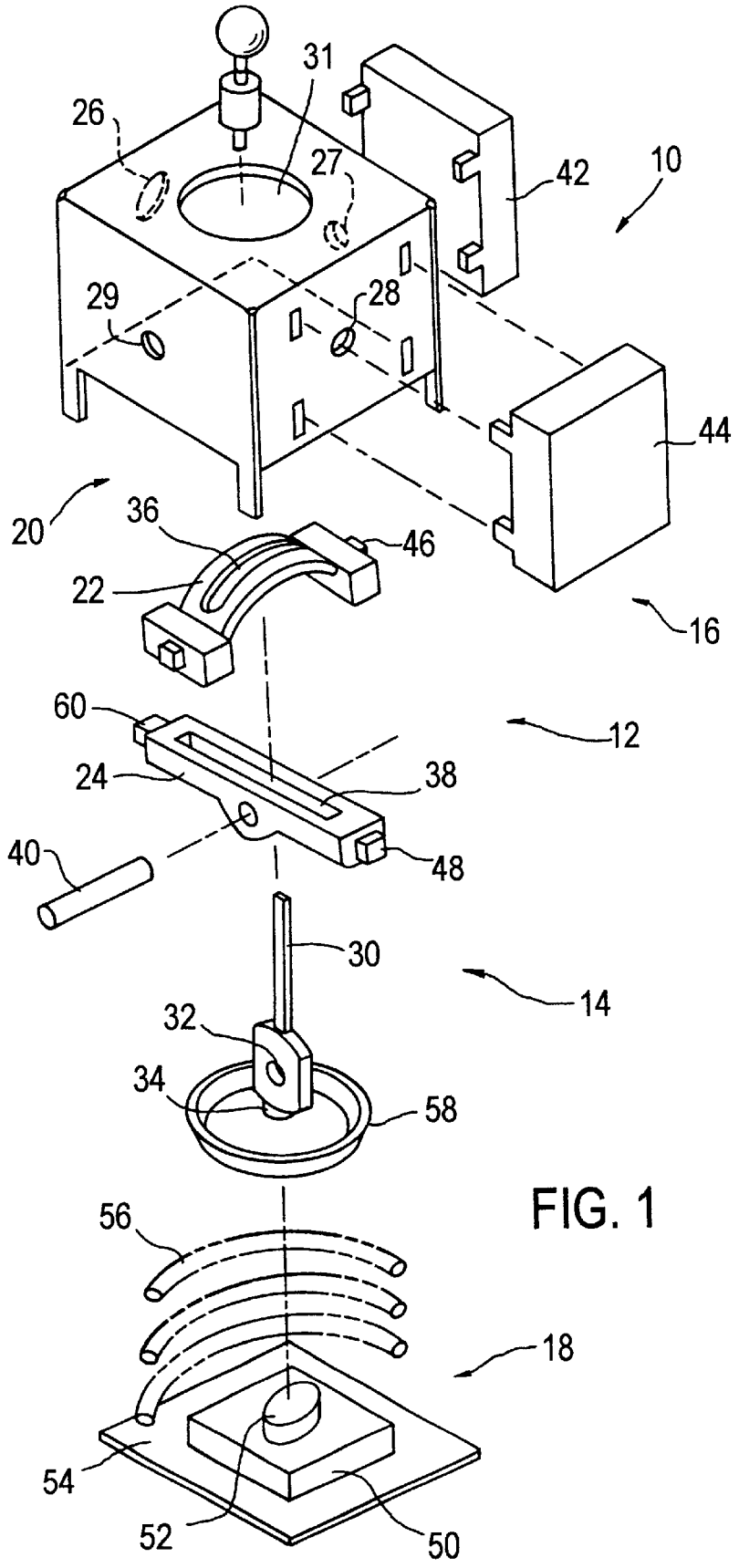
FIG. 1 is an exploded perspective view of a preferred embodiment of the control device or pointing stick.
Figure 2:
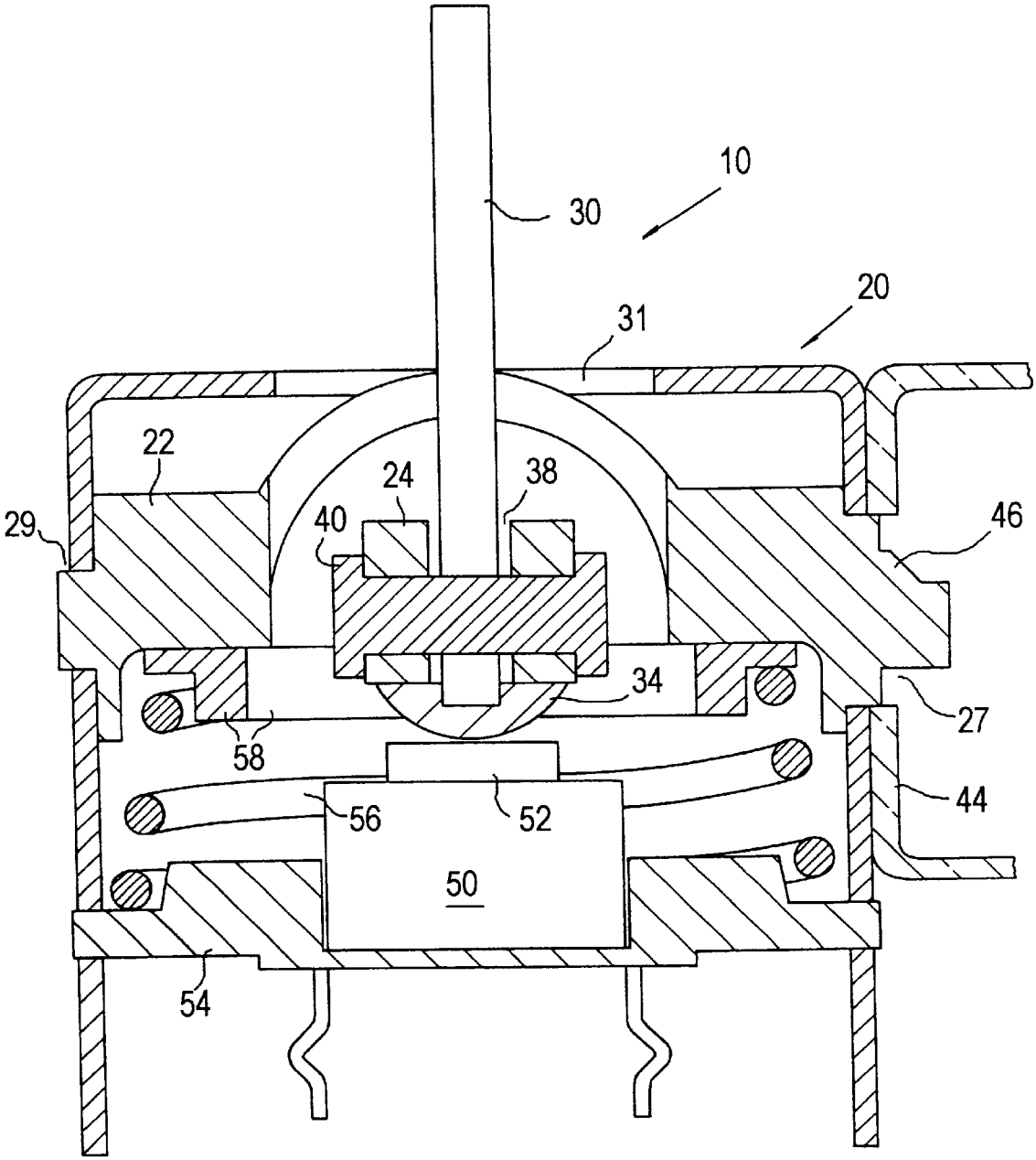
FIG. 2 is a cross-sectional view of most elements of FIG. 1

Referring to FIGS. 1 and 2, there is a control device or pointing stick 10 that can, for example, be used to control the movement of a curser on a computer screen (not shown). The control device 10 is made up of a gimbal assembly 12, a control stick assembly 14, position sensor mechanism 16, a switch assembly 18 and a housing assembly 20. Uniquely, gimbal assembly 12 has a first yoke 22, and a second yoke 24. Housing assembly 20 has slot 26, holes 27, 28 and 29, and opening 31. Control stick assembly 14 includes shaft 30, mounting hole 32, and actuator or cap 34. Stick assembly 14 is pivotally coupled to gimbal assembly 12 by inserting shaft 30 through grooves 36 and 38, and lockably inserting hinge pin 40 therethrough. Position sensor mechanism 16 comprises two position sensors 42 and 44 mounted to housing 20 to allow the sensing of a rotational position of each yoke 22 and 24. Yokes 22 and 24 are rotatably coupled to sensors 42 and 44 via tabs 46 and 48 respectively. Switch assembly 18 includes switch 50, button 52, base 54, biasing means or spring 56, and spring retainer 58.

Uniquely, FIG. 2 illustrates the pointing stick 10 in a centered or centering position. That is, a position that has shaft 30 in a vertical position that allows the shaft to be moved an equal and maximum distance in all directions perpendicular to the shaft.

One skilled in the art of joy sticks and switches will easily understand one operation of the present embodiment. Uniquely, spring 56 resiliently forces cap 34 away from button 52 by exerting opposite forces on base 54 and retainer 58, thus forcing tab 60 to a highest point in slot 26. To close switch 50, a user may apply sufficient pressure to shaft 30 to cause yoke tab 60 to slide down slot 26, and thus forcing cap 34 onto button 52 to thereby close switch 50.

Additionally, the operation of the gimbal assembly 12 and sensor mechanism 16 is easily understandable to one skilled in the appropriate arts. For example, shaft 30 may be displaced in a direction that is perpendicular to the shaft and parallel to yoke 24. This displacement causes shaft 30 to slide along groove 38 and contact sides of groove 36, which rotates tab 46 and subsequently position sensor 44 will generate a new signal representative of the new rotational position of tab 46. During the shaft displacement, tab 48 may remain in an unchanged position or may also be displaced causing similar position sensor signal generation.

Figure 3:
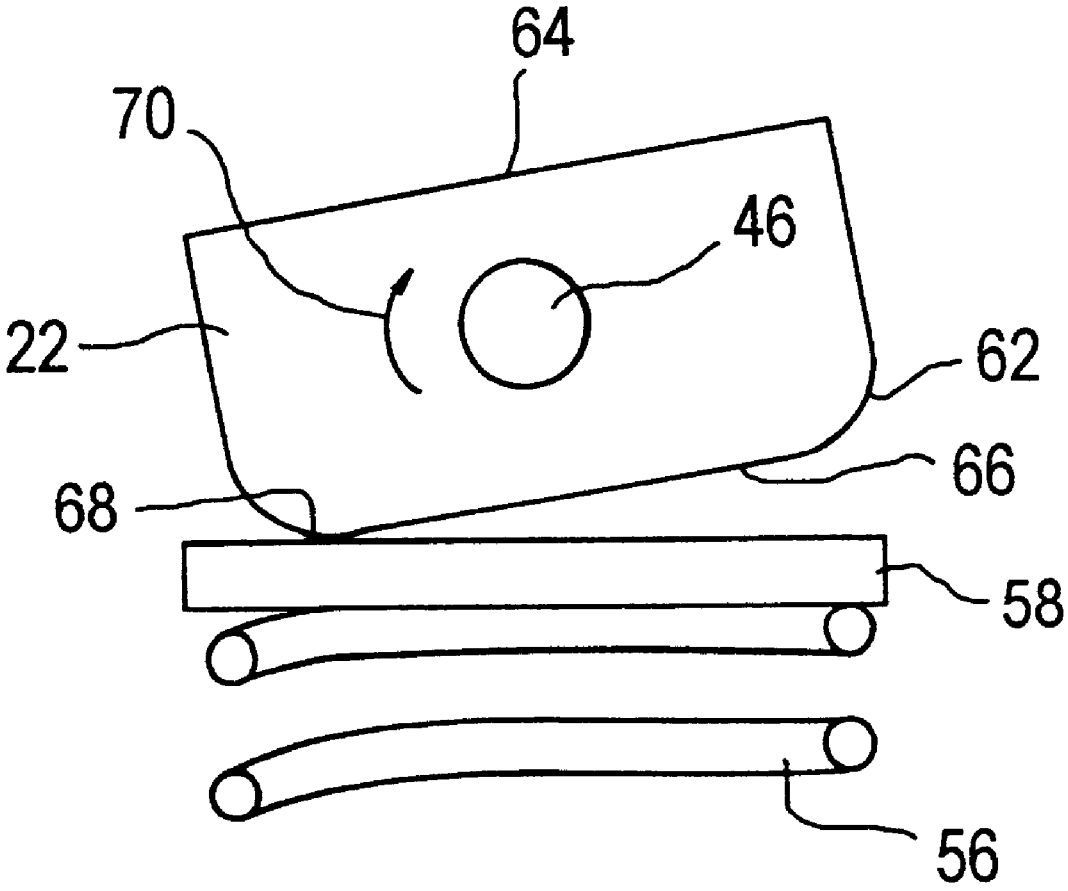
FIG. 3 is a cross-sectional representative schematic end view of a yoke from FIGS. 1 and 2.

Referring to FIG. 3, there is a representative schematic end view of yoke 22 at locations of contact with retainer 58. The view is for illustration of a basic operation of the yokes 22 and 24 and is not an exact view of the part. Specifically, by way of example, it is illustrated that yoke 22 is placed in a non-centered or centering position, which has the shaft (not shown) and yoke tilted to the left, creating contact between rounded corner 68 and retainer 58. Rounded corner 62 and bottom surface 66 are separated from retainer 58. Tab 46 will rotate about its axis and remain rotatably fixed in hole 27 (not shown).

While in this illustrated position, there is a torque 70 created about tab 46, which forces yoke 22 back to the centered position.

A skilled artisan will easily understand the operation of the self centering operation provided by the features in FIG. 3. It is well understood that torque 70 forces the yoke 22 back to a centering position that has zero or minimal torque. Specifically, as yoke 22 is forced to rotate to the left, corner 62 is lifted off retainer 58. This causes rounded comer 68 to force retainer 58 downward. Rounded corner 68 will smoothly slide along a top surface of retainer 58 because of the smooth rounded shape. When the rotating force is removed from yoke 22, spring 56 will push upward sufficiently to cause the yoke to rotate back into a position that has surface 66 against retainer 66; thus, achieving the centering position of the joystick. It is noted that top surface 64 does not have to have rounded edges and can be most any shape and not impact upon the self centering feature of the invention.

The spring pressure, retainer 58 and shape of the yoke's 22 and 24 contribute to a cost-effective design. The flat surface 66 along with the rounded corners 62 and 68, interact with the flat retainer 58 to allow for smooth operation with minimal parts. Specifically, the shape of the yokes 22 and 24, at the locations in contact with the retainer 58, minimize the torque about tabs 46 and 48 when in the centering position; in fact the torque is essentially equal to zero at the centering position. When the shaft 30 is moved, causing the yokes to rotate about the tabs, there is an increase in the torque about the tabs that act to force the yokes back into the centering position.

REMARKS ABOUT THE PREFERRED EMBODIMENT

One of ordinary skill in the arts of switches and gimbal designs, will realize many advantages from using the preferred embodiment. In particular, control stick assembly 14 is mounted to gimbal assembly 12 to allow pivotal motion in two axises of direction once locking pin 40 is affixed thereto. Additionally, slot 26 and spring 56 are arranged to allow yoke 24 to pivot downward sufficiently to close switch 50.

Additionally, after reviewing the preferred embodiment, a skilled artisan will understand the importance of a small footprint. Specifically, by placing switch 50 inside housing 20 there is eliminated the extra space that would have been used if switch 50 were to be placed on the outside housing 20.

It is further noted that a skilled artisan would realize the importance of eliminating extra parts in assembling the joystick 10. Specifically, other collars for centering spring 56 could have been unnecessarily used.

Another advantage to be noted about the invention is the self centering feature. A skilled artisan will understand that

VARIATIONS OF THE PREFERRED EMBODIMENT(S)

One of ordinary skill in the art of making joy sticks using switches, sensors and gimbals will realize that there are many different ways of accomplishing key features of the preferred embodiment. Uniquely, position sensors 42 and 44 may be any type of sensor capable of generating signals representative of the rational position of the respective yokes 22 and 44, like a potentiometer or hall effect devices using magnets.

Although it is illustrated to use a spring 56, it is equally contemplated to use any biasing creating means like elastic polymers.

Although, the embodiment discusses the use of a separate cap 34, it is contemplated to use an integral cap that is part of shaft 30.

Similarly, although the embodiment discloses the use a rounded convex groove 36, one skilled in the gimbal arts would realize that most any type of gimbal that provides two degrees of motion could work. For example, see any of the cited art examples, like U.S. Pat. No. 4,729,253.

A skilled artisan will realize that though yoke 22 is the only illustrated self centering yoke, it is understood that all appropriate edges of both ends of both yokes 22 and 24 are similarly designed to achieve the self centering feature of the invention.

Additionally, a skilled artisan will know of many shapes for the yokes 22 and 24 that can minimize the torque about tabs 46 and 48 when in the centering position and can also increase the torque when the yokes are axially rotated. The first and second yokes, at a location that contacts For example, the yokes could have a square shape, a cam shape at the location of contact with the retainer 58.

Although the invention has been taught with specific reference to these embodiments, someone skilled in the art will recognize that many other changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A device for electrically controlling an object, comprising:

a) a housing;

b) a stick assembly, mounted in the housing, the stick assembly having an end extending from the housing and another end having a cap attached thereto;

c) a gimbal assembly having the stick assembly mounted thereto and contained within the housing, the gimbal assembly including:

c1) a first and second yokes coupled to the stick assembly for allowing the stick assembly to move therein, the yokes having a pair of ends extending outside of the housing;

c2) a pair of sensors, mounted to the ends of the yokes for generating an electrical output signal indicative of a position of the stick assembly, the sensors mounted outside the housing;

d) a retainer, disposed adjacent the gimbal assembly, the retainer disposed circumferentially around the stick assembly;

e) a base having a cavity therein, the base mounted to the housing;

f) a switch, positioned in the cavity below the cap, the switch activated when the stick assembly is sufficient displaced in a direction parallel to the stick assembly so as to cause the cap to contact the switch and to close the switch; a spring located between the retainer and the base for biasing the gimbal assembly away from the switch;

g) a mounting hole extending through the shaft for pivotally and slidably securing the shaft to the gimbal assembly;

h) a hinge pin extending through the second yoke and mounting hole to allow the shaft to pivotally move; and i) a first and second grooves, located in the first and second yokes, respectively for allowing the shaft to pivot therein;

j) a plurality of terminals electrically connected to the switch and extending through the base.

* * * * *